US005927057A

United States Patent [19]

Hueber

[11] Patent Number: 5,927,057

[45] Date of Patent: Jul. 27, 1999

[54] RAKE FOR GOLF COURSE BUNKERS

[75] Inventor: David B. Hueber, Ponte Vedra, Fla.

[73] Assignee: D. B. Hueber Golf Company, Ponte Verda Beach, Fla.

[21] Appl. No.: 08/788,220

[22] Filed: Jan. 27, 1997

[51] Int. Cl.[6] ..... A01D 7/06

[52] U.S. Cl. ..... 56/400.06; 56/400.21; 56/400.04; D8/13

[58] Field of Search ..... 56/400.01, 400.04, 56/400.05, 400.06, 400.21, 400.07; D8/13

[56] References Cited

U.S. PATENT DOCUMENTS

| | | | |
|---|---|---|---|
| D. 346,938 | 5/1994 | Tucker . | |
| D. 350,464 | 9/1994 | Colonello . | |
| D. 373,056 | 8/1996 | Hueber . | |
| 1,151,584 | 8/1915 | Hartman | 56/400.06 |
| 2,779,374 | 1/1957 | Clark . | |
| 4,741,150 | 5/1988 | Saksun . | |
| 5,042,812 | 8/1991 | Tillman . | |
| 5,179,825 | 1/1993 | Griffiths . | |
| 5,605,034 | 2/1997 | South et al. | 56/400.07 |

OTHER PUBLICATIONS

Accuform brochure (2 pages) no date.
SandMaster brochure by Midwest (2 pages) no date.
Standard Golf brochure pg. 18 no date.
Midwest Rake Company, 1994, brochure (4 pages).
Par Aide brochure, p.14 (no date).

*Primary Examiner*—Heather Shackelford
*Attorney, Agent, or Firm*—Tilton, Fallon, Lungmus & Chestnut

[57] ABSTRACT

A rake for sand golf course bunkers having an egg-shaped head shape, a row of tines extending outward from one surface of the head, each of which taper from a wide oval shape at the surface of the rake head to a round tip, and a ridge on the opposite surface of the head for smoothing over lines formed in the sand by the tines.

1 Claim, 2 Drawing Sheets

RAKE FOR GOLF COURSE BUNKERS

BACKGROUND OF THE INVENTION

1. Field of the Invention

This invention relates generally to rakes and, more specifically, to a rake for golf course sand traps or bunkers.

2. Description of the Prior Art

Among the techniques golf courses employ to increase the level of difficulty of a particular golf hole is to provide bunkers or sand traps near areas of the fairway or green where golfers are likely to hit golf balls. It can take a golfer several strokes to hit a golf ball back out of a bunker onto the fairway or green, even with a special golf club such as a sand wedge. Golfers typically leave footprints in the sand when they step into the bunker to hit golf ball s back onto the fairway. Furthermore, when the golfer takes a stroke with a golf club, he or she will invariably displace the sand in the bunker.

To return the bunker to its condition before the golfer retrieved his or her golf ball, it is common to use a rake. One problem with conventional rakes is that they tend to leave lines or ridges in the sand where the tines of the rake passed over the sand. Seeking to solve this problem, the Saksun patent, U.S. Pat. No. 4,741,150, teaches a rake for a golf course bunker having a reversible head with tines on one side of the head and a flat portion on the other side of the head. The side of the head with the tines is used to substantially even out the sand in the bunker, the head is then turned over, and the flat portion is used to smooth over the lines formed by the tines on the surface of the sand. The tines are round and the head is substantially cylindrical.

One problem with conventional rakes is durability. Since rakes on golf courses are typically left on the courses 24 hours a day, they must stand up to the elements. Also, it would be desirable to have a rake with tines that do not bend or break, even when subjected to large forces, such as golf cart tires in the event someone accidentally runs over the rake. Another problem is that the handle has a tendency to become dislodged from the head of the rake. This is due to inadequate dimensions of the head portion of the rake. As explained below, the present invention overcomes these and other problems in prior art rakes.

SUMMARY OF THE INVENTION

The present invention includes a rake having a handle and a head, the head having a row of tines on the front surface and a raised ridge on the opposite or rear surface. In the preferred embodiment, the head is egg-shaped in cross-section and has a central sleeve or bore extending through the top end of the head to receive the handle and terminating at the bottom end of the head to hold the handle in place and prevent foreign objects from entering the handle. The egg-shape of the head provides room for a longer sleeve to support the handle than conventional rakes. By coordinating conventional securing means, such as a set screw, with the longer sleeve in the head portion for receiving the handle, a more reliable connection is achieved.

An important aspect of the present invention is the shape of the tines extending from the head. Instead of flat or cylindrical tines, a tapered shape is used. The tines are wider and oval-shaped at their base on the front surface of the head of the rake, and taper to a circular cross-section at their top, with a hemispherical tip. In the preferred embodiment, the tines are positioned at the widest point on the head of the rake. Also, the taper is only in one direction, i.e., on one side of the tine, whereas the other side of the tine is straight, such that the tine has a webbed-L shape, with the long part of the tine extending outward from the widest point on the head of the rake, and the short part of the tine and the webbed area extending toward the top of the head. The tapered shape imparted to the tines provides the tines with added strength over conventional tines.

On the rear surface of the head, positioned opposite the row of tines, a ridge extends along the length of the head. The ridge is preferably approximately ⅜ inch high and ¼ inch wide, and is supported by six strategically placed tapered braces that extend between the ridge and the surface of the head of the rake, having their widest point at the surface of the head and their most narrow point at the top of the ridge, opposite the surface of the head of the rake. The ridge provides an effective surface for smoothing over lines in sand made by the row of tines on the opposite side of the head. It is found that this ridge smoothes sand more effectively than conventional rakes which utilize the flat portion on the rear of the head to smooth over lines made by such a rake's tines. When the whole flat portion is used, the rake has a tendancy to skip off the surface of the sand, or dig too deep into the sand. The curvilinear surface of the egg-shaped head, combined with the raised ridge, enable the rake to be easily pulled or pushed along the surface of the sand, thereby displacing and moving the desired amount of material to level and smooth the sand without the need for repetitive raking to correct for gaps or ditches made by the rake head.

The handle is made from wood, fiberglass, or plastic and includes a thermoplastic golf grip on the end where a user holds the handle. The grip serves the dual purposes of facilitating the user's handling of the rake and extending the life of the handle by protecting it from the elements. Conventional fiberglass rake handles tend to splinter over time due to exposure to sunlight. The thermoplastic grip therefore also protects a user's hands from getting any fiberglass splinters. The grip is similar to grips on golf clubs, which offers familiarity to golfers so they will be more likely to use the rake to repair a bunker after hitting a golf ball back onto the fairway or green.

DESCRIPTION OF THE DRAWING

This invention can be more easily understood with the detailed description of the preferred embodiments below and by reference to the accompanying drawings, in which.

DETAILED DESCRIPTION OF THE PREFERRED EMBODIMENT

Figure 1:
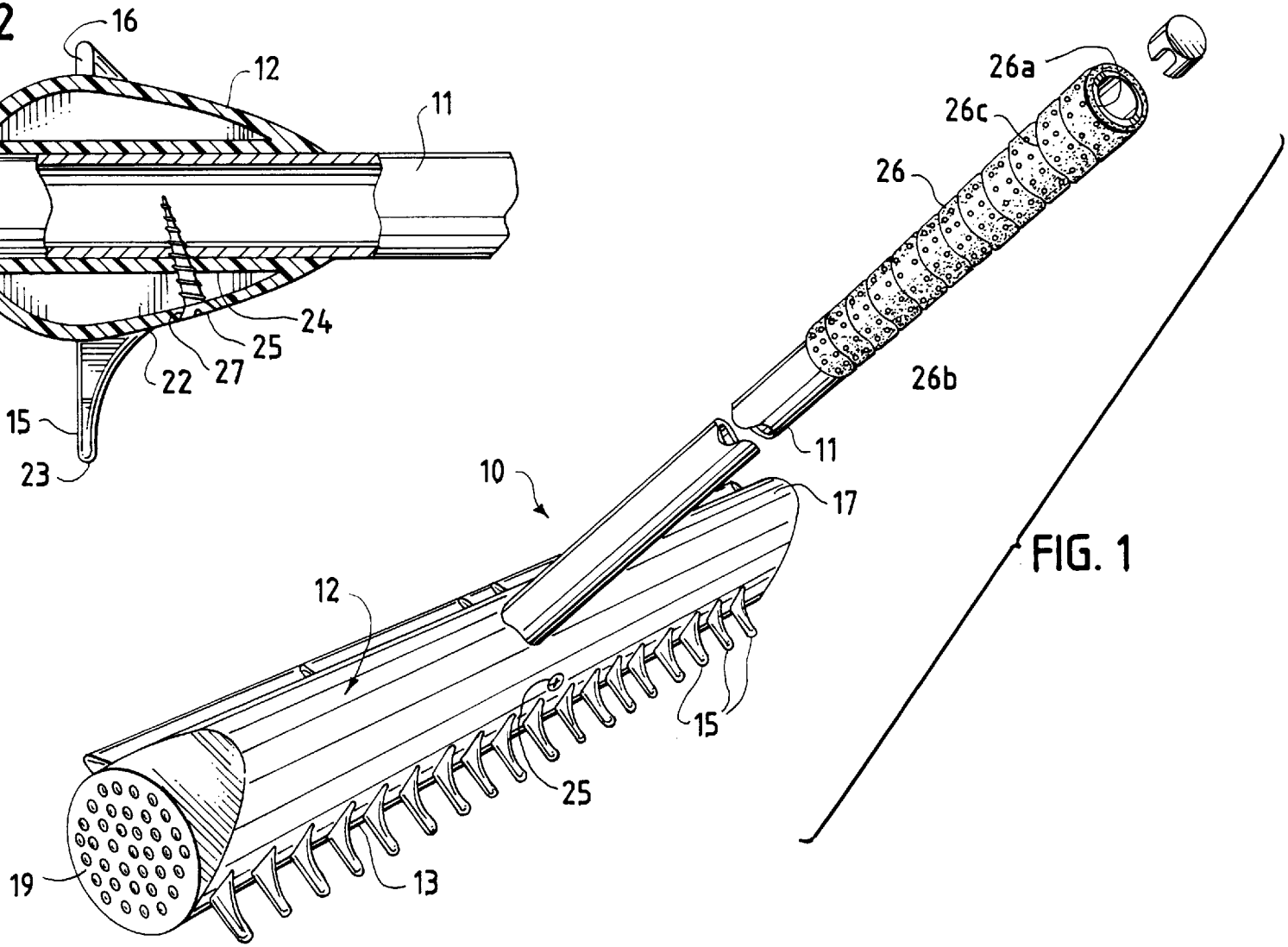
FIG. 1 is a perspective view, partially broken away, of the rake of the present invention.
Figure 2:
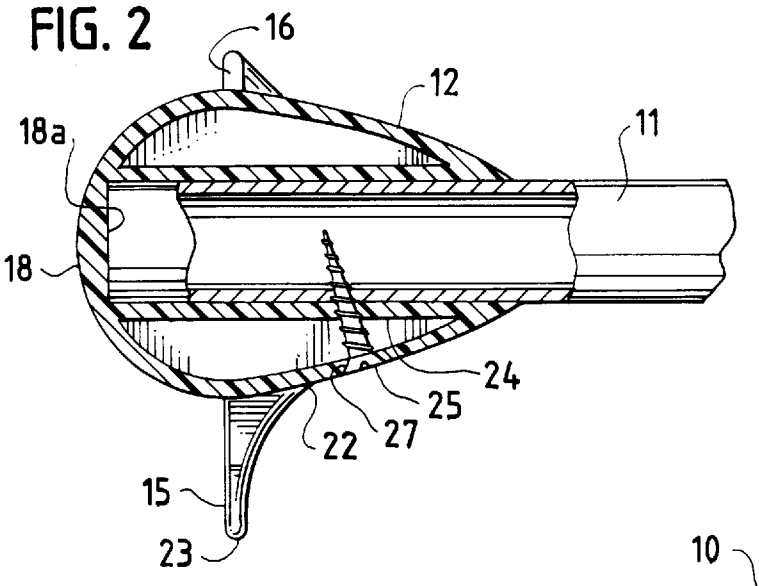
FIG. 2 is a fragmentary sectional view of the rake.
Figure 3:
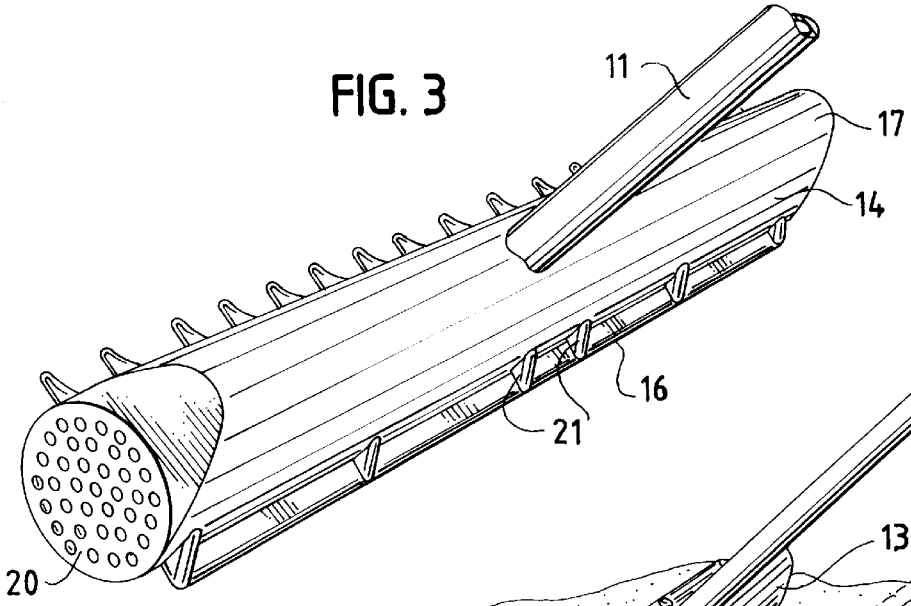
FIG. 3 is a fragmentary perspective view of the rake showing the ridge.

Referring first to FIGS. 1–3, a rake for a golf course bunker shown generally as 10 consists of a handle 11 and a head 12. The head 12 has a front surface 13, a rear surface 14, a row of tines 15 extending across the front surface 13, a ridge 16 extending across the rear surface 14, a top 17, a bottom 18, and end walls 19 and 20. Each of the tines on the front surface of the rake includes a lower end 22 at the front surface of the rake and tapers to a rounded top with a hemispherical tip 23. It is recognized that the tip 23 of the tines may alternatively be flat or dimpled inward, rather than hemispherical, without losing significant strength of the rake. Only one side of the tine is tapered in the preferred embodiment, with the other side of the tine being straight, resulting in a tine having a webbed-L shape. The long part of the webbed-L shape extends outward from the head of the rake at the widest part of the head, and the short part of the tine and the webbed portion extend toward the top 17 of the head. The tines are approximately ¼ inch by ½ inch at the surface of the head, and have a diameter of approximately ¼ inch at the tip 23. The tines are preferably arranged equally spaced from one another along the front surface of the head, and project from the head such that the more narrow ¼ inch portion of each of the tines tills the sand of a golf course bunker over the entire tine, rather than the ½ inch wide portion where the webbed-L shape intersects with the surface of the head. In this orientation, structural strength is provided to the tines without hindering the ability to till the sand. It is found that tines shaped according to the present invention are stronger than conventional tines and resist breakage.

On the rear surface 14, the ridge 16 is supported by several supporting braces 21 which extend between the ridge 16 and the head 12.

The head 12 includes a sleeve or a bore 24 in the top 17 extending to the bottom 18 in order to receive the handle 11. The handle 11 is secured to the head 12 by means of a set screw 25 which seats i n bore 27 in the front 13 of the head of the rake. Besides the front surface 13, the rear surface 14, the top 17, the bottom 18, the end walls 19, 20, and the bore 24, the head 12 is otherwise hollow. Because bore 24 is only open at the top 17 of the head, there is an end wall 18a to the bore 24 that is integral with the bottom is of the head. The end wall 18*a* keeps the handle from protruding outward through the bottom of the rake head, and reduces stresses on set screw 25. It is recognized that an additional benefit of end wall 18*a* is that foreign elements such as sand, water, and grass clippings are less likely to permeate into the hollow rake head cavity or the handle. Such foreign elements are undesirable in either the rake head or the handle, as they tend to add weight to the rake and make the rake sound-like a salt shaker when it is moved. The handle 11 can be made from materials such as wood, fiberglass or plastic, and includes a grip portion 26. In the preferred embodiment, the handle is made of fiberglass and is provided with a honeycomb core 26*a* that tends to strengthen the handle. The grip portion is made of thermoplastic material and serves several purposes, including protecting the user's hands from fiberglass splinters on the handle, protecting the handle from natural elements, and providing the user with a cushioned grip, similar to golf club grips, to provide familiarity and facilitate raking. The grip portion 26 is preferably long enough for a user to hold the grip with both hands. Slipping between a user's hands and the grip portion is prevented by the grip portion being tapered downward in the direction toward the head of the rake, and textured with dimples 26*b* and at least one spiral indention 26*c* that winds down the length of the grip.

The head 12 is preferably egg-shaped or ovoid, with the portion of the egg-shape having a wider radius of curvature being closest to the ground and the portion of the egg-shape having a narrower radius of curvature being adjacent to and receiving the handle. The cross-section of the head is approximately 1⅞ inch by 2⅞ inch. This shape provides several advantages. First, the bore 24 for receiving the handle 11 extends nearly 3 inches, which is a greater distance than in conventional golf course rake heads, and provides a more stable connection between the handle 11 and the rake head 12. Conventional cylindrical rake heads typically have a diameter of approximately 2 inches, which necessarily limits the length of the bore or sleeve which supports the rake handle. Second, egg shapes perform quite well when subjected to compressive forces.

The length of the head can vary depending on such factors as the shape of the sand trap and the preference of the user. For particularly large sand traps, it may be desirable to provide a longer head having tines and a ridge extending over a greater distance, to minimize raking time. A standard size is a length of approximately 16 inches. It is recognized that substantially longer heads can be implemented having the same cross-sectional shape, tine shape, and handle securing means as the rake described above.

Figure 4:
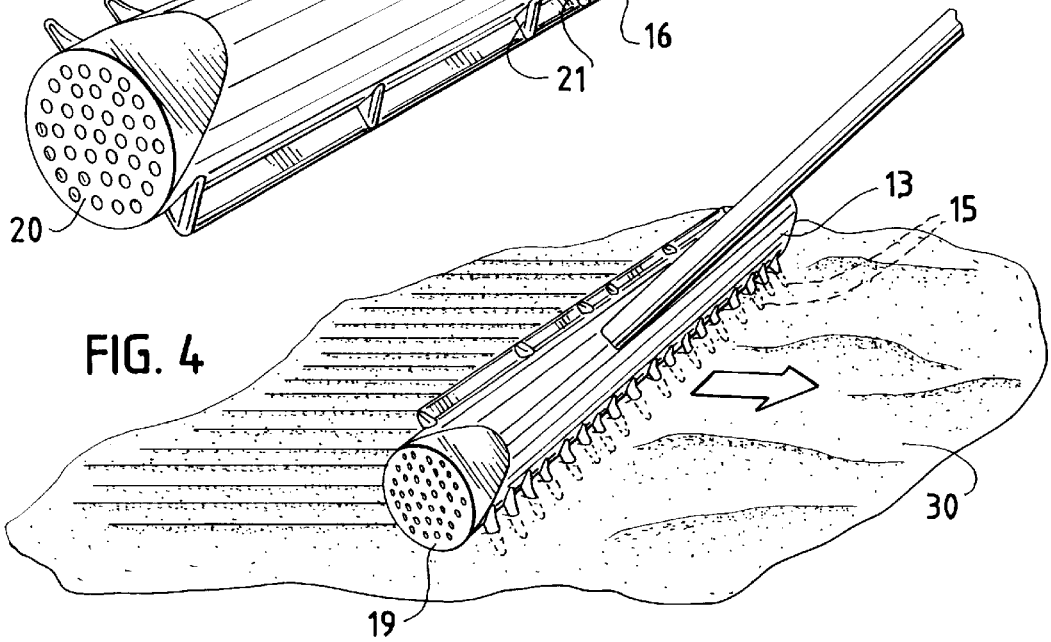
FIG. 4 is a fragmentary perspective view of the rake using the tine side of the rake to smooth a golf course bunker.
Figure 5:
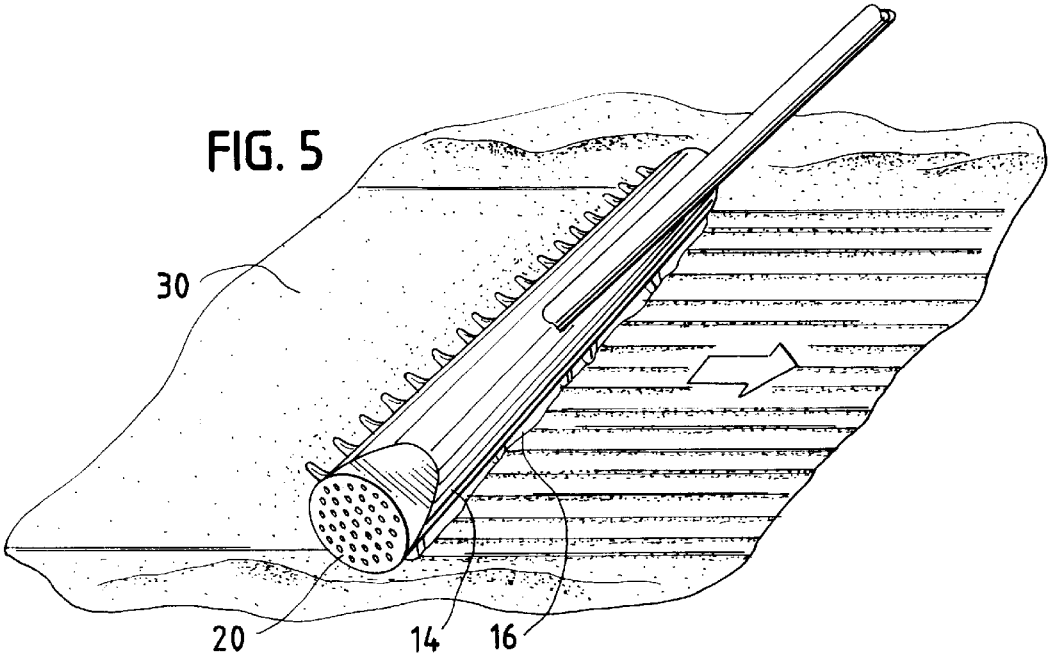
FIG. 5 is a fragmentary perspective view of the rake using the ridge side of the rake to cover the grooves made by the tine side of the rake.

As shown in FIGS. 4 and 5, the rake is preferably operated by first applying the front surface of the rake 13 having the tines 15 to a sand golf course bunker 30 and evening the surface of the sand to a desired level by pulling and/or pushing the tines of the rake through the sand using the rake handle, then rotating the rake using the handle so the rear surface 14 with the ridge 16 faces the sand, and finally, pushing or pulling the ridge side to smooth over the area of the sand where grooves were left by the tines on the rake by pulling and/or pushing the ridge portion of the rake head through the sand with the handle. It is recognized that the ridge side of the rake head may also be used as a squeegee on golf greens to dissipate accumulation of water on the greens after rain showers.

The rake 10 is manufactured using an injection molding process to form the rake head 12. It is recognized that higher quality materials such as ABS plastic, injection molded under high pressure, yields a more uniform and stronger rake head than using lower quality materials or less costly molding processes, such as blow molding. The handle 11, the head 12, and the grip 26 are all provided with ultraviolet, or "UV" protection, in order to increase the rake's resistance to long term exposure to sunlight.

It will be understood that while in the foregoing specification a detailed description of specific embodiments of the invention were set forth for the purpose of illustration, many of the details herein can be varied considerably by those skilled in the art without departing from the spirit and scope of the invention.

I claim:

1. A tool used to even a granular playing surface comprising:

an elongated head having an egg-shaped cross section with a bottom surface having a relatively large radius of curvature, a top surface having a relatively small radius of curvature, a front surface, a back surface, a central bore extending through the top surface tot he bottom surface, and two side walls;

a plurality of tines extending in a row perpendicularly and outwardly from the front surface of the elongated head, each of the tines having an oval-shaped based at the front surface of the elongated head and tapering to a round tip;

a ridge extending outwardly along the back surface of the elongated head opposite the row of tines on the front surface of the head;

a plurality of reinforcement braces extending between the ridge and the back surface of the elongated head, the reinforcement braces tapering from a widest portion at the back surface of the elongated head to a narrowest portion at the tip of the ridge;

an elongated handle extending through the bore in the elongated head and terminating at the bottom surface of the elongated head;

a set screw extending through the front surface of the elongated head and the central bore and into the handle for securing the handle in the elongated head; and a thermoplastic grip disposed on the end of the handle opposite the elongated head.

* * * * *